US010488789B2

(12) United States Patent
Funatani et al.

(10) Patent No.: US 10,488,789 B2
(45) Date of Patent: Nov. 26, 2019

(54) IMAGE-FORMING APPARATUS FOR CHARGING TONER REMAINING ON AN INTERMEDIATE TRANSFER MEMBER USING A CHARGING UNIT AND COLLECTING THE CHARGED TONER

(71) Applicant: CANON KABUSHIKI KAISHA, Tokyo (JP)

(72) Inventors: Kazuhiro Funatani, Mishima (JP); Takamitsu Soda, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/113,778

(22) Filed: Aug. 27, 2018

(65) Prior Publication Data

US 2019/0064708 A1 Feb. 28, 2019

(30) Foreign Application Priority Data

Aug. 30, 2017 (JP) ..... 2017-166004

(51) Int. Cl.

| | |
|---|---|
| ***G03G 15/16*** | (2006.01) |
| ***G03G 15/01*** | (2006.01) |
| ***G03G 15/00*** | (2006.01) |
| ***G03G 21/10*** | (2006.01) |

(52) U.S. Cl.

CPC ..... *G03G 15/1665* (2013.01); *G03G 15/0131* (2013.01); *G03G 15/161* (2013.01); *G03G 15/80* (2013.01); *G03G 21/10* (2013.01); *G03G 2215/1657* (2013.01)

(58) Field of Classification Search

CPC . G03G 15/1665; G03G 15/80; G03G 15/0131
See application file for complete search history.

(56) References Cited

U.S. PATENT DOCUMENTS 5,196,893 A * 3/1993 Nishise ..... G03G 15/161 399/279
2016/0132015 A1* 5/2016 Uno ..... G03G 15/0136 399/71

FOREIGN PATENT DOCUMENTS

JP 2000056573 A * 2/2000
JP 2009063681 A * 3/2009
JP 2009-205012 A 9/2009
JP 2011085953 A * 4/2011 ..... G03G 15/168

(Continued)

*Primary Examiner* — Susan S Lee
(74) *Attorney, Agent, or Firm* — Canon USA, Inc., IP Division

(57) ABSTRACT

An image-forming apparatus includes a control unit configured to perform a first collection operation in which toner that has passed a position at which the charging unit and the intermediate transfer member are in contact with each other is moved from the intermediate transfer member to the image bearing member. The control unit is also configured to perform a second collection operation in which toner having been moved from the charging unit to the intermediate transfer member is moved from the intermediate transfer member to the image bearing member. The control unit controls rotation speed of the image bearing member in such a manner that the rotation speed of the image bearing member in the second collection operation is slower than the rotation speed of the image bearing member in the first collection operation.

17 Claims, 6 Drawing Sheets

(56) References Cited

FOREIGN PATENT DOCUMENTS

| | | | |
|---|---|---|---|
| JP | 2017-16038 | A | 1/2017 |
| JP | 2017-142540 | A | 8/2017 |

* cited by examiner

IMAGE-FORMING APPARATUS FOR CHARGING TONER REMAINING ON AN INTERMEDIATE TRANSFER MEMBER USING A CHARGING UNIT AND COLLECTING THE CHARGED TONER

BACKGROUND

Field

The present disclosure relates to an image-forming apparatus employing an electrophotographic process, such as a copier or a printer.

Description of the Related Art

A known color image-forming apparatus that employs an electrophotographic process has a configuration in which image forming sections corresponding to various colors transfer respective toner images consecutively onto an intermediate transfer member and then transfer the toner images from the intermediate transfer member onto a transfer medium.

In such an image-forming apparatus, the image forming section for each color has a drum-shaped photosensitive member (hereinafter referred to as a "photosensitive drum"), which serves as an image bearing member. A toner image formed on the photosensitive drum of the image forming section for each color is primary-transferred onto the intermediate transfer member, such as an intermediate transfer belt, while a primary transfer power supply applies a voltage to a primary transfer member that is disposed so as to oppose the photosensitive drum with the intermediate transfer member interposed therebetween. The image forming section for each color transfers (i.e., primary-transfers) each color toner image onto the intermediate transfer member. Each color toner image is subsequently secondary-transferred from the intermediate transfer member onto a transfer medium, such as a sheet of paper or an OHP sheet, while a secondary transfer power supply applies a voltage to a secondary transfer member in a secondary transfer portion. Each color toner image transferred onto the transfer medium is subsequently fixed on the transfer medium in a fixing unit.

Japanese Patent Laid-Open No. 2009-205012 discloses a configuration in which cleaning of the intermediate transfer member is performed in such a manner that residual toner remaining on the intermediate transfer member (i.e., residual toner) after a toner image is secondary-transferred onto a transfer medium is collected electrostatically by a photosensitive drum. In this configuration, a charging member is disposed downstream of the secondary transfer member with respect to the moving direction of the intermediate transfer member. Residual toner is charged while the residual toner passes through a region where the charging member is in contact with the intermediate transfer member. The residual toner is subsequently moved by the intermediate transfer member to a region where the photosensitive drum is in contact with the intermediate transfer member. In this region, the residual toner is transferred in reverse from the intermediate transfer member to the photosensitive drum due to a potential difference between the photosensitive drum and the intermediate transfer member. The residual toner that has been moved onto the photosensitive drum is collected into a cleaning unit by using a cleaning blade, which serves as a contact member. The cleaning blade is disposed so as to abut the photosensitive drum and removes the residual toner from the photosensitive drum.

In the case in which the residual toner that is moved onto the photosensitive drum is collected by the cleaning blade as disclosed in Japanese Patent Laid-Open No. 2009-205012, toner collection efficiency is affected largely by the amount of electrostatic charge of the toner to be collected. For example, toner that adheres to the charging member during collection operation is rubbed with the moving intermediate transfer member in the region where the charging member is in contact with the intermediate transfer member. The amount of electrostatic charge of such toner tends to be larger compared with the toner that passes through the region where the charging member is in contact with the intermediate transfer member without adhering to the charging member.

The toner that is moved from the intermediate transfer member to the photosensitive drum while having a large amount of electrostatic charge has a large electrostatic power to adhere to the photosensitive drum. Accordingly, the toner that adheres to the photosensitive drum may pass the position at which the cleaning blade is in contact with the photosensitive drum.

SUMMARY

Aspects of the present disclosure are directed to providing a favorable cleaning performance in an image-forming apparatus in which residual toner remaining on an intermediate transfer member is moved to an image bearing member and collected by a contact member that abuts the image bearing member, regardless of the amount of electrostatic charge of the toner that has been moved to the image bearing member.

According to aspects of the disclosure, an image-forming apparatus includes an image bearing member that bears a toner image, an intermediate transfer member that is movable and onto which the toner image is primary-transferred from the image bearing member, a transfer member that is disposed at a position corresponding to the image bearing member with the intermediate transfer member interposed therebetween, a power supply that applies a voltage to the transfer member, a charging unit that is disposed, with respect to a moving direction of the intermediate transfer member, downstream of a secondary transfer portion where the toner image is secondary-transferred from the intermediate transfer member onto a transfer medium and that charges toner that has passed through the secondary transfer portion in a state the charging unit being in contact with the intermediate transfer member, a charging power supply that applies a voltage to the charging unit, and a contact member configured to contact with the image bearing member and collects toner adhering to the image bearing member.

The image-forming apparatus further includes a control unit configured to perform a first collection operation in which toner that has passed a position at which the charging unit and the intermediate transfer member are in contact with each other in a state in which the charging power supply applies the voltage having the predetermined polarity is moved from the intermediate transfer member to the image bearing member, and a second collection operation in which toner having been moved from the charging unit to the intermediate transfer member is moved from the intermediate transfer member to the image bearing member. In the image-forming apparatus, the control unit performs the first collection operation by applying the voltage having the predetermined polarity from the power supply to the transfer member and performs the second collection operation by applying a voltage having an opposite polarity opposite to the predetermined polarity from the power supply to the transfer member. In addition, the control unit controls rotation speed of the image bearing member in such a manner that the rotation speed of the image bearing member in the second collection operation is slower than the rotation speed of the image bearing member in the first collection operation.

Further features of aspects of the present disclosure will become apparent from the following description of exemplary embodiments with reference to the attached drawings.

DESCRIPTION OF THE EMBODIMENTS

Examples will be described with reference to the drawings. Note that dimensions, materials, shapes, relative positions, or the like, of elements described in the examples below are to be changed appropriately in accordance with configurations and various conditions of an apparatus to which aspects of the present disclosure is applied, and accordingly, the examples described below should not be construed as limiting the invention.

Example 1

Configuration of Image-Forming Apparatus

Figure 1:
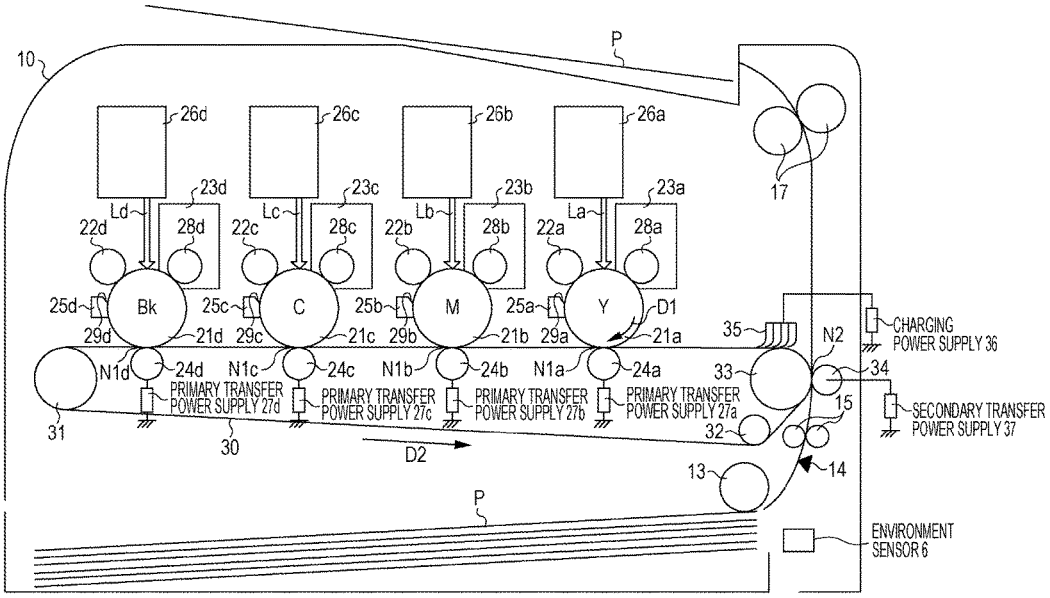
FIG. 1 is a cross-sectional view schematically illustrating a configuration of an image-forming apparatus according to Example 1.
Figure 2:
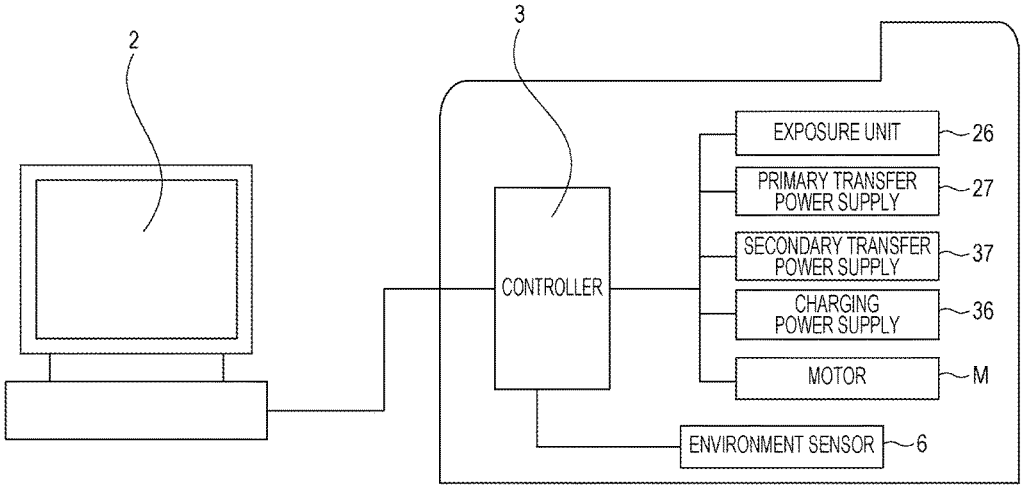
FIG. 2 is a block diagram related to Example 1.

FIG. 1 is a cross-sectional view schematically illustrating an image-forming apparatus 10 according to the present example. FIG. 2 is a block diagram related to a control system of the image-forming apparatus 10 according to the present example. As illustrated in FIG. 2, the image-forming apparatus 10 is connected to a personal computer 2, which serves as a host apparatus. The personal computer 2 transmits an instruction for starting operation and image signals to a controller 3, which serves as a control unit. While the controller 3 controls various units, the image-forming apparatus 10 performs image forming.

As illustrated in FIG. 1, the image-forming apparatus 10 is a color image-forming apparatus that employs an electrophotographic process and an intermediate image transfer system. The image-forming apparatus 10 includes four image forming sections for forming respective images of yellow (Y), magenta (M), cyan (C), and black (K). The four image forming sections are arranged in a row with a constant spacing provided between adjacent image forming sections. In FIG. 1, suffixes a, b, c, and d represent yellow, magenta, cyan, and black, respectively, and elements denoted by reference symbols with the suffixes a, b, c, and d serve for yellow, magenta, cyan, and black. The configurations and operations of multiple image forming sections are substantially the same except for the colors of toners to be used. Accordingly, when it is not necessary to focus on differences, image forming sections will be described collectively by omitting suffixes a, b, c, and d, which are provided to indicate that corresponding elements are for individual colors.

In each of the image forming sections, a photosensitive drum 21 (i.e., a photosensitive member) that has a cylindrical shape and serves as an image bearing member is disposed. A charging roller 22 that serves as a unit for charging the photosensitive drum 21, a development unit 23, and a cleaning unit 25 are disposed around the photosensitive drum 21. In addition, an exposure unit 26 (laser scanner) is disposed downstream of the charging roller 22 and upstream of the development unit 23 with respect to the rotation direction of the photosensitive drum 21.

In the present example, the photosensitive drum 21 is an organic photoreceptor with negative chargeability. The photosensitive drum 21 has a photosensitive layer on an aluminum drum base and is rotationally driven by a motor M, which serves as a drive source, in the direction of arrow D1 (clockwise) in FIG. 1 at a predetermined peripheral speed. In the present example, the peripheral speed is set to 210 mm/sec during image forming.

The charging roller 22 is in contact with the photosensitive drum 21 with a predetermined pressing force. The charging roller 22 charges the surface of the photosensitive drum 21 uniformly to a predetermined potential while a high-voltage power supply (not illustrated) for charging applies a desired charging voltage to the charging roller 22. In the present example, the charging roller 22 charges the photosensitive drum 21 to a negative polarity.

The exposure unit 26 outputs laser light L corresponding to image information onto the surface of the photosensitive drum 21, scans the surface, and exposes the surface to light. The exposure unit 26 thereby forms an electrostatic latent image (electrostatic image) corresponding to the image information onto the surface of the photosensitive drum 21.

The development unit 23 has a development roller 28, which serves as a toner bearing member. The electrostatic latent image formed on the photosensitive drum 21 is developed into a toner image by using toner born by the development roller 28 in an opposing region (development region) where the development roller 28 opposes the photosensitive drum 21. At this moment, a development voltage having the same polarity as the normal charging polarity of toner (i.e., negative polarity in the present example) is applied to the development roller 28 by a high-voltage power supply for development (not illustrated).

In the present example, the electrostatic latent image formed on the photosensitive drum 21 is developed by using a reversal development method. In other words, toner charged to negative polarity, which is the same polarity as the charging polarity of the photosensitive drum 21, adheres to the portion of the photosensitive drum 21 that has been exposed to light by the exposure unit 26. Thus, the electrostatic latent image is developed into a toner image. Note that a contact development method is used in the present example. However, a non-contact development method may also be used. In the present example, a reversal development method is also used in developing the electrostatic latent image. However, aspects of the present disclosure can be applied to an image-forming apparatus that utilizes a positive development method for developing an electrostatic latent image by using toner charged to a polarity opposite to the charging polarity of the photosensitive drum 21.

The cleaning unit 25 has a cleaning blade 29 disposed therein. The cleaning blade 29 serves as a contact member that is in contact with the photosensitive drum 21 and collects toner attached to the photosensitive drum 21 into the cleaning unit 25. The cleaning blade 29 is a plate-like member made of an elastic material. In the present example, a plate-like member made of a urethane rubber as an elastic material is used to form the cleaning blade 29.

In the present example, an intermediate transfer belt formed of polyethylene naphthalate (PEN) resin was used as the intermediate transfer belt 30 (intermediate transfer member). The intermediate transfer belt 30 initially exhibited a surface resistivity of $5.0\times10^{11}$ Ω/sq. and a volume resistivity of $8.0\times10^{11}$ Ωcm.

A resin, such as polyvinylidene difluoride (PVDF), ethylene-tetrafluoroethylene copolymer (ETFE), polyimide resin, polyethylene terephthalate (PET), or polycarbonate, can be used for the intermediate transfer belt 30. Alternatively, to form the intermediate transfer belt 20 as an endless belt, a rubber base layer made of, for example, ethylene-propylene-diene rubber (EPDM) may be used, and the surface of the rubber base layer is covered by urethane rubber in which a fluorocarbon polymer, such as polytetrafluoroethylene (PTFE), is dispersed. In addition, a coat layer made of, for example, an acrylic material may be provided on the surface of the above-described base layers. Such a multi-layered member can be preferably used for the endless belt.

The intermediate transfer belt 30 extends around a drive roller 31, a tension roller 32, and an opposing roller 33. Drive power for rotation is transmitted from a motor M to the drive roller 31, thereby causing the intermediate transfer belt 30 to move in the direction of arrow D2 in FIG. 1. In the present example, the peripheral speed of the intermediate transfer belt 30 is set to 210 mm/sec, which is the same as that of the photosensitive drum. Thus, the intermediate transfer belt 30 is rotationally driven at the speed that is substantially same as the peripheral speed of the photosensitive drum 21.

A primary transfer roller 24, which serves as a transfer member, is disposed on the inner peripheral side of the intermediate transfer belt 30 at a position corresponding to each photosensitive drum 21. The primary transfer roller 24 is preferably formed of an elastic material, such as polyurethane rubber, EPDM, or nitrile-butadiene rubber (NBR).

The primary transfer roller 24 as the transfer member presses the intermediate transfer belt 30 toward the photosensitive drum 21 and thereby forms a primary transfer portion N1 where the photosensitive drum 21 and the intermediate transfer belt 30 are in contact with each other. The primary transfer roller 24 rotates as the intermediate transfer belt 30 moves. A primary transfer power supply 27 is connected electrically to the primary transfer roller 24. While the primary transfer power supply 27 applies a voltage having positive polarity (a predetermined polarity) to the primary transfer roller 24, the toner image formed on the photosensitive drum 21 is primary-transferred from the photosensitive drum 21 onto the intermediate transfer belt 30 in the primary transfer portion N1.

Toner that has not been transferred to the intermediate transfer belt 30 and has remained on the photosensitive drum 21 is moved by rotation of the photosensitive drum 21 to a position at which the cleaning blade 29 is in contact with the photosensitive drum 21. Consequently, the residual toner is collected in the cleaning unit 25 by the cleaning blade 29.

A secondary transfer roller 34 is in contact with the outer peripheral surface of the intermediate transfer belt 30 at a position opposing the opposing roller 33 and thereby forms a secondary transfer portion N2. A secondary transfer power supply 37 is connected electrically to the secondary transfer roller 34. While the secondary transfer power supply 37 applies a positive polarity voltage (i.e., voltage having positive polarity) to the secondary transfer roller 34, the toner image that has been primary-transferred onto the intermediate transfer belt 30 is secondary-transferred onto a transfer medium P in the secondary transfer portion N2.

In synchronization with the timing at which the multicolor toner image that has been primary-transferred onto the intermediate transfer belt 30 reaches the secondary transfer portion N2, a pickup roller 13 feeds a transfer medium P. A registration sensor 14 detects the position of the leading edge of the transfer medium P that has been fed by the pickup roller 13, and a conveyance roller pair 15 conveys the transfer medium P to the secondary transfer portion N2. Subsequently, the transfer medium P to which the multicolor toner image has been secondary-transferred in the secondary transfer portion N2 is conveyed to a fixing unit 17 where the transfer medium P is heated and pressed. As a result, the multicolor toners are fused and blended, and fixed on the transfer medium P, which is discharged from the image-forming apparatus 10.

The toner that has not been secondary-transferred to the transfer medium P in the secondary transfer portion N2 and has remained on the intermediate transfer belt 30 (hereinafter referred to as "residual toner") is moved by the intermediate transfer belt 30 and is subsequently charged by a charging brush 35, which serves as a charging unit. The residual toner is moved further by the intermediate transfer belt 30 to the primary transfer portion N1. When the residual toner passes through the primary transfer portion N1, the potential difference between the intermediate transfer belt 30 and the photosensitive drum 21 causes the residual toner to be transferred electrostatically from the intermediate transfer belt 30 to the photosensitive drum 21. Thus, the residual toner is collected by the cleaning unit 25.

The charging brush 35 is a brush member that is made of nylon fibers to which electroconductivity is imparted. The brush width is 4 mm, and the pile length is 4 mm. With respect to the moving direction D2 of the intermediate transfer belt 30, the charging brush 35 is disposed downstream of the secondary transfer portion N2 and upstream of the primary transfer portion N1 of the most upstream image forming section. The charging brush 35 is in contact with the intermediate transfer belt 30 at a position opposing the opposing roller 33 in such a manner that the charging brush 35 is urged against the intermediate transfer belt 30 to an inroad amount of 1 mm.

A charging power supply 36 is connected electrically to the charging brush 35. The charging power supply 36 is able to apply a voltage having positive or negative polarity to the charging brush 35. A collection operation to collect residual toner will be described in detail below.

First Collection Operation for Residual Toner

The charging power supply 36 applies a positive polarity voltage (predetermined polarity) to the charging brush 35. Residual toner is thereby charged to positive polarity at the region where the charging brush 35 is in contact with the intermediate transfer belt 30. In the present example, the positive polarity voltage applied to the charging brush 35 was set to approximately 1500 V. Note that the voltage to be applied varies depending on the electric resistance of the intermediate transfer belt 30, environment conditions, and other factors.

The residual toner, which has passed through the region where the charging brush 35 is in contact with the intermediate transfer belt 30 and has been charged to positive polarity, is moved by the intermediate transfer belt 30. The residual toner reaches the primary transfer portion N1*a* of the most upstream image forming section. Here, a primary transfer power supply 27*a* applies a positive polarity voltage to a primary transfer roller 24*a*, which causes the residual toner having been charged to positive polarity to move electrostatically from the intermediate transfer belt 30 to a photosensitive drums 21*a*.

After the residual toner charged to positive polarity is moved onto the photosensitive drum 21*a*, the residual toner is collected in a cleaning unit 25*a* by a cleaning blade 29*a*. Thus, residual toner that passes through the region where the charging brush 35 is in contact with the intermediate transfer belt 30 and that is charged to positive polarity is collected in the collection operation (first collection operation).

Second Collection Operation for Residual Toner

The residual toner that has passed through the secondary transfer portion N2 may contain toner charged to negative polarity. During the first collection operation, such toner charged to negative polarity adheres to the charging brush 35 to which a positive polarity voltage is applied, and the toner accumulates in the gap between the charging brush 35 and the intermediate transfer belt 30. If the amount of toner that adheres to the charging brush 35 increases, residual toner may not be charged sufficiently during the first collection operation, which leads to faulty cleaning. In the present example, a second collection operation is performed to prevent this from occurring. In the second collection operation, the negatively charged toner (i.e., toner charged to negative polarity) adhering to the charging brush 35 is collected by causing the toner to move onto the intermediate transfer belt 30 and then to move electrostatically from the intermediate transfer belt 30 to the photosensitive drum 21.

Figure 3:
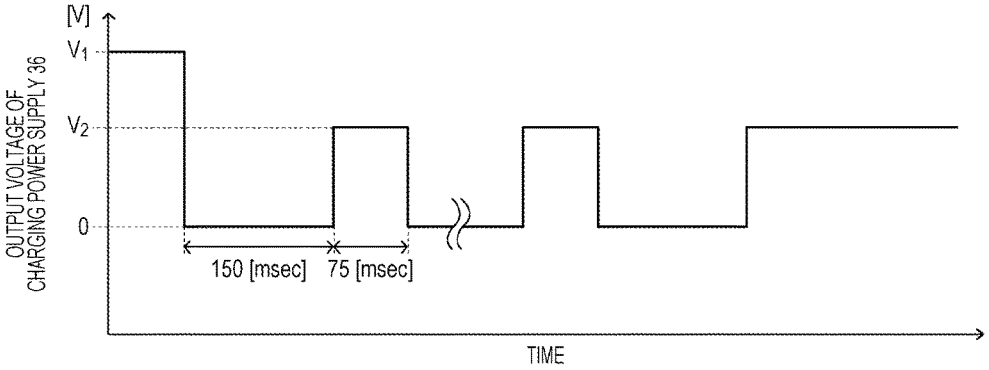
FIG. 3 is a timing diagram illustrating a second collection operation in Example 1.

FIG. 3 is a timing diagram illustrating the output voltage of the charging power supply 36 when the negatively charged toner adhering to the charging brush 35 is moved onto the intermediate transfer belt 30 in the second collection operation.

As illustrated in FIG. 3, when the second collection operation is started, voltage $V_1$ that has been applied to the charging brush 35 to charge the residual toner to positive polarity is stopped, and the output voltage of the charging power supply 36 applied to the charging brush 35 is set to 0 V. After a predetermined elapsed time, voltage $V_2$ having positive polarity is applied to the charging brush 35 and subsequently voltage $V_2$ is stopped. By repeating this step, negatively charged toner adhering to the charging brush 35 is moved from the charging brush 35 to the intermediate transfer belt 30.

More specifically, the charging power supply 36 applies voltage $V_2$ to the charging brush 35 at 150 milliseconds after stopping voltage $V_1$ that has been applied to the charging brush 35, and 75 milliseconds later, the output voltage of the charging power supply 36 is returned to 0 V. After repeating this switching step several times, the voltage applied to the charging brush 35 is switched to a positive polarity voltage, and this voltage is maintained. Thus, the operation to move the negatively charged toner from the charging brush 35 to the intermediate transfer belt 30 is completed.

By stopping application of voltage $V_1$ to the charging brush 35, the negatively charged toner that has adhered electrostatically to the charging brush 35 is discharged onto the intermediate transfer belt 30. Moreover, by repeating the switching step, the negatively charged toner adhering electrostatically to the charging brush 35 is subject to electrostatic oscillation, which can improve the performance of toner discharge from the charging brush 35. In the present example, voltage $V_1$ is set to +1500 V and voltage $V_2$ is set to +200 V in the second collection operation. In addition, in the present example, the voltage applied to the charging brush 35 after repeating the switching step is set to voltage $V_2$.

The negatively charged toner that has been discharged from the charging brush 35 to the intermediate transfer belt 30 is moved by the intermediate transfer belt 30 to the primary transfer portion N1*a* of the most upstream image forming section. The negatively charged toner, which has been moved from the charging brush 35 to the intermediate transfer belt 30, is further moved electrostatically from the intermediate transfer belt 30 to the photosensitive drum 21*a* by applying a negative polarity voltage from the primary transfer power supply 27*a* to the primary transfer roller 24*a*. The toner moved to the photosensitive drum 21*a* is consequently collected in the cleaning unit 25*a* by the cleaning blade 29*a* as is the case for the first collection operation.

The polarity of the voltage applied to the primary transfer roller 24 during image forming is positive. However, in the second collection operation, it is necessary to apply the negative polarity voltage to the primary transfer roller 24. Accordingly, the second collection operation is performed not during image forming but during other non-image-forming occasions, such as post-rotation after image forming or pre-rotation before image forming.

In the present example, as described above, the voltage applied to the charging brush 35 is stopped and the output voltage of the charging power supply 36 is set to 0 V when performing the switching step. However, for example, the switching step may be repeated by using a positive polarity voltage that the charging power supply 36 applies to the charging brush 35 and that is smaller in absolute value than voltage $V_1$. Alternate application of positive polarity voltages that are different in absolute value generate electrostatic oscillation, which can discharge the toner adhering to the charging brush 35 onto the intermediate transfer belt 30. Alternatively, the switching step may be repeated by using a negative polarity voltage that the charging power supply 36 applies to the charging brush 35. Application of the negative polarity voltage from the charging power supply 36 to the charging brush 35 in the switching step can further improve the performance of discharge of the toner adhering to the charging brush 35.

As described above, in the first collection operation and the second collection operation according to the present example, positively or negatively charged residual toner is collected by the photosensitive drum 21*a* that is disposed upstream of any other photosensitive drums with respect to the moving direction of the intermediate transfer belt 30. However, any photosensitive drum other than the photosensitive drum 21*a* can collect residual toner by controlling the direction of an electric field formed in each of the primary transfer portions N1. For example, the direction of the electric field formed in each of the primary transfer portions N1 can be controlled by controlling the polarity and the output voltage applied to the corresponding charging roller 22 and exposure unit 26 and by controlling the polarity and the output voltage applied to the corresponding primary transfer roller 24 by the primary transfer power supply 27. Alternatively, multiple photosensitive drums may collect residual toner in a coordinated manner by controlling the direction of the electric field formed in each of the primary transfer portions N1.

Control of Rotation Speed of Photosensitive Drum

In the present example, the rotation speed of the photosensitive drum 21 in the second collection operation is reduced compared with the speed in the first collection operation, thereby improving the efficiency of collecting the toner that has been moved from the charging brush 35 to the intermediate transfer belt 30.

In the case in which the residual toner remaining on the photosensitive drum 21 is collected by the cleaning blade 29 that abuts the photosensitive drum 21 as the contact member, the toner collection efficiency is affected largely by the amount of electrostatic charge of the toner to be collected. When the amount of electrostatic charge of the toner is large, electrostatic adhesive power acting between the toner and the photosensitive drum 21 becomes large. The efficiency of the cleaning blade 29 collecting toner thereby decreases, which leads to faulty cleaning. This may result in performing image forming while residual toner is still present on the photosensitive drum 21, which may cause image defects.

Table 1 shows the amount of electrostatic charge of toner to be collected into the cleaning unit 25 of the photosensitive drum 21 in each case of the collection operations, according to the study by the inventors. In Table 1, toner A is residual toner remaining on the photosensitive drum 21 after the primary transfer. Toner B is toner to be collected in the cleaning unit 25 in the first collection operation, and toner C is toner to be collected in the cleaning unit 25 in the second collection operation.

The amount of electrostatic charge of toner in the present example was measured by using E-spart Analyzer EST-G available from Hosokawa Micron Corporation. For measuring the amount of electrostatic charge of toner A, toner adhering to the photosensitive drum 21 was sampled after performing the primary transfer while stopping the image forming operation. For measuring the amount of electrostatic charge of toner B and toner C, respective toners adhering to the photosensitive drum 21 were sampled while stopping operation of the image-forming apparatus 10 after the toners had been moved from the intermediate transfer belt 30 to the photosensitive drum 21 in the first collection operation and in the second collection operation.

TABLE 1

| | Amount of electrostatic charge [μC/g] |
|---|---|
| Toner A | −30 |
| Toner B | +10 |
| Toner C | −80 |

Toner A reaches the cleaning unit 25 of the photosensitive drum 21 immediately after the primary transfer, and an increase in the amount of electrostatic charge in absolute value caused by rubbing or the like does not tend to occur. Toner B, which has been charged to positive polarity by the charging brush 35, also reaches the position at which the cleaning blade 29 abuts the photosensitive drum 21 without an increase in the amount of electrostatic charge caused by rubbing or the like. Thus, the amount of electrostatic charge in absolute value does not tend to increase. On the other hand, toner C is rubbed between the charging brush 35 and the intermediate transfer belt 30 while adhering to the charging brush 35, and the amount of electrostatic charge of toner C in absolute value tends to increase due to friction.

In the present example, the peripheral speed of the photosensitive drum 21 in the second collection operation in which the amount of electrostatic charge of toner in absolute value tends to increase is set to be slower than the peripheral speed of the photosensitive drum 21 in the first collection operation. With this configuration, the toner collection efficiency can be improved at the position at which the cleaning blade 29 abuts the photosensitive drum 21.

Table 2 summarizes peripheral speeds of the photosensitive drum 21 in the second collection operation and evaluation results for cleaning performance. The cleaning performance was evaluated by using a method described below.

Forming an image having a page coverage of 200% of a secondary color (solid color image) was started and interrupted before the image forming was completed. Residual toner left on the intermediate transfer belt 30 due to the interruption of the image forming was collected by the first collection operation and by the second collection operation. Subsequently, an image having a page coverage of 0% (solid white image) was formed repeatedly, and the cleaning performance in the second collection operation was evaluated for each of the peripheral speeds by observing the degree of stain adhering to transfer media P.

Note that in the evaluation of the cleaning performance, the peripheral speed of the photosensitive drum 21 was set to 210 mm/sec during image forming and during the first collection operation. In addition, sheets of paper GF-C081 (available from Canon) were used, and the image forming mode was set to plain paper mode. The throughput of the image-forming apparatus 10 was 38 sheets per minute. The following symbols and criteria were used for evaluating the cleaning performance. A: no toner adhered to transfer media P and no stain occurred in a formed image; B: minor stain occurred in a formed image; and C: conspicuous stain occurred in a formed image.

TABLE 2

| Peripheral speed of photosensitive drum 21 [mm/sec] | Cleaning performance |
|---|---|
| 210 | C |
| 140 | B |
| 70 | A |
| 35 | A |

As indicated in Table 2, according to the study by the inventors, the cleaning performance can be improved by decreasing the peripheral speed of the photosensitive drum 21 during the second collection operation compared with the speed of the photosensitive drum 21 during the first collection operation. When the peripheral speed of the photosensitive drum 21 was set to 140 mm/sec in the second collection operation, the cleaning performance was improved compared with the case of the peripheral speed of the photosensitive drum 21 being set to 210 mm/sec although toner faintly adhered to a transfer medium P.

Figure 4:
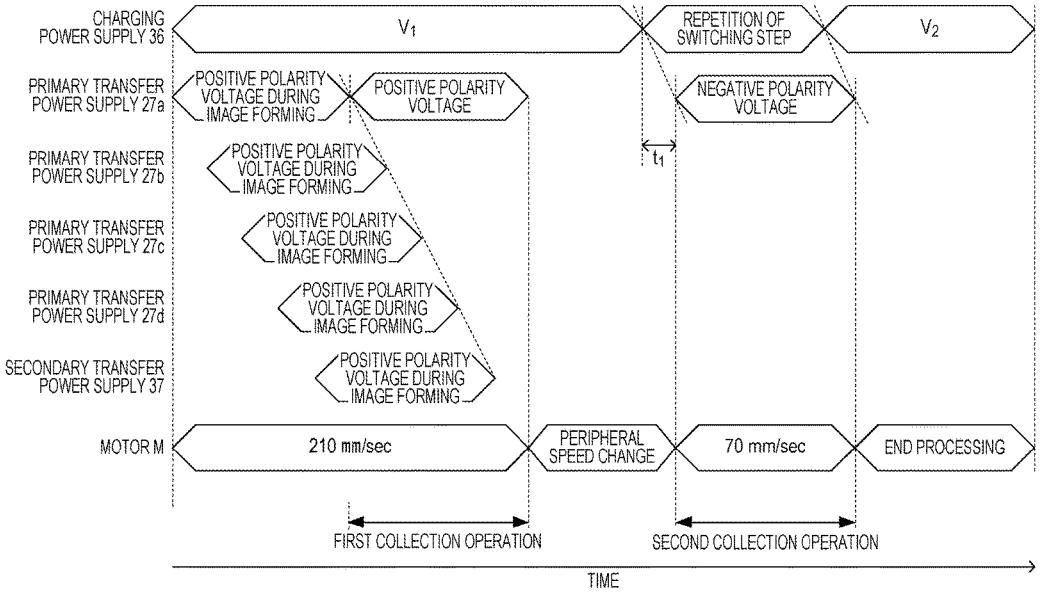
FIG. 4 is a timing diagram illustrating collection operations for residual toner in Example 1.

Moreover, when the peripheral speed of the photosensitive drum 21 was set to 70 mm/sec or less in the second collection operation, favorable cleaning performance was obtained without stain occurring in a formed image due to toner adhering to a transfer medium P. Accordingly, in the present example, the peripheral speed of the photosensitive drum 21 was set to 210 mm/sec in the first collection operation, while the peripheral speed of the photosensitive drum 21 was set to 70 mm/sec in the second collection operation. FIG. 4 is a timing diagram when residual toner is collected in the present example.

As illustrated in FIG. 4, in the image forming, a toner image is primary-transferred by applying a positive polarity voltage from the primary transfer power supply 27 to the primary transfer roller 24, and the toner image is secondary-transferred by applying a positive polarity voltage from the secondary transfer power supply 37 to the secondary transfer roller 34. Residual toner that has passed through the secondary transfer portion N2 is charged to positive polarity by the charging brush 35 to which the charging power supply 36 applies voltage $V_1$ having positive polarity. The residual toner is subsequently transferred from the intermediate transfer belt 30 to the photosensitive drum 21*a* in the primary transfer portion N1*a* and collected in the cleaning unit 25*a*. Thus, the image forming operation and the first collection operation are performed.

In FIG. 4, elapsed time t1 (milliseconds) is the time required for the intermediate transfer belt 30 to move from the charging brush 35 to the primary transfer portion N1*a* of the most upstream image forming section. When the secondary transfer of the toner image is completed and the first collection operation for collecting residual toner charged to positive polarity by the charging brush 35 is completed, the peripheral speed of the intermediate transfer belt 30 and the photosensitive drum 21 is switched from 210 mm/sec to 70 mm/sec. In synchronization with the timing at which switching of the peripheral speed of the intermediate transfer belt 30 and the photosensitive drum 21 is completed, voltage $V_1$ applied by the charging power supply 36 to the charging brush 35 is stopped, and the repetition of the switching step is started.

Here, the timing of stopping voltage $V_1$ is set to t1 milliseconds earlier than the timing at which the switching of the peripheral speed of the photosensitive drum 21 and the intermediate transfer belt 30 is completed. In other words, when the negatively charged toner that is discharged from the charging brush 35 to the intermediate transfer belt 30 by stopping voltage $V_1$ reaches the primary transfer portion N1*a* of the most upstream image forming section, the peripheral speed of the photosensitive drum 21 has already been 70 mm/sec.

In synchronization with the timing at which the negatively charged toner discharged onto the intermediate transfer belt 30 reaches the primary transfer portion N1*a*, the primary transfer power supply 27*a* applies a negative polarity voltage to the primary transfer roller 24*a*. As a result, the negatively charged toner, which has been moved from the charging brush 35 to the intermediate transfer belt 30, is further moved from the intermediate transfer belt 30 to photosensitive drum 21*a*. The negatively charged toner is consequently collected by the cleaning unit 25*a* of the photosensitive drum 21*a*. Thus, the second collection operation is performed.

After the switching step is repeated the predetermined number of times, the voltage that the charging power supply 36 applies to the charging brush 35 is switched to positive polarity voltage $V_2$, and this voltage is maintained. Thus, the discharge of the negatively charged toner from the charging brush 35 to the intermediate transfer belt 30 is completed. In addition, the application of the negative polarity voltage to the primary transfer roller 24*a* is stopped in synchronization with the timing at which a position on the intermediate transfer belt 30 to which the last toner has been discharged passes the primary transfer portion N1*a*.

The voltage applied to the charging brush 35 is subsequently stopped in synchronization with stopping the movement of the intermediate transfer belt 30. Thus, the sequence of the operation is completed while no negatively charged toner having been discharged from the charging brush 35 is left on the intermediate transfer belt 30.

In the present example, as described above, the peripheral speed of the photosensitive drum 21 in the second collection operation is set to be slower than that in the first collection operation. This can improve the toner collection efficiency in the second collection operation in which the amount of electrostatic charge of toner tends to increase, thereby suppressing the occurrence of image defects caused by faulty cleaning.

Note that in the present example, the negative polarity voltage is applied to the primary transfer roller 24*a* in the image forming section of the most upstream image forming section. However, the negative polarity voltage may be applied to at least one of the primary transfer rollers 24. Accordingly, it is a matter of choice which one of the primary transfer rollers 24 the negative polarity voltage is applied to or whether or not the negative polarity voltage is applied to a plurality of the primary transfer rollers 24.

In the present example, toner is discharged from the charging brush 35 onto the intermediate transfer belt 30 in synchronization with the completion of switching the peripheral speed of the intermediate transfer belt 30. However, for example, in the case in which it takes time to switch the polarity of the voltage that the primary transfer power supply 27*a* applies to the primary transfer roller 24*a*, the negatively charged toner may be discharged from the charging brush 35 in synchronization with the timing of switching the voltage of the primary transfer power supply 27*a*.

In the present example, as described above, the photosensitive drums 21 and the intermediate transfer belt 30 are rotationally driven by the common motor M. However, the photosensitive drums 21 and the intermediate transfer belt 30 may be rotated by separate drive sources. Moreover, in the present example, the peripheral speeds of the photosensitive drums 21 and the intermediate transfer belt 30 during the image forming are set to be substantially the same. However, the peripheral speeds of the photosensitive drums 21 and the intermediate transfer belt 30 may be set differently so as to take advantage of peripheral speed difference. In the case of using the common motor M, it is possible to provide the peripheral speed difference by changing the gear ratio or the diameter of the drive roller 31 for transmitting the drive power from the drive source.

It is known that when toner is used less frequently, the amount of electrostatic charge of the toner tends to increase. Accordingly, in an initial phase of the use of the image-forming apparatus 10, in which the total number of transfer media P passing through the secondary transfer portion N2 does not exceed the predetermined number of sheets, the second collection operation may be performed at a peripheral speed of the photosensitive drum 21 slower than that in the first collection operation. This can suppress the occurrence of image defects caused by the faulty cleaning while reducing the time required for the collection operation for residual toner in the initial phase of the use of the image-forming apparatus 10.

Modification Example

Figure 5:
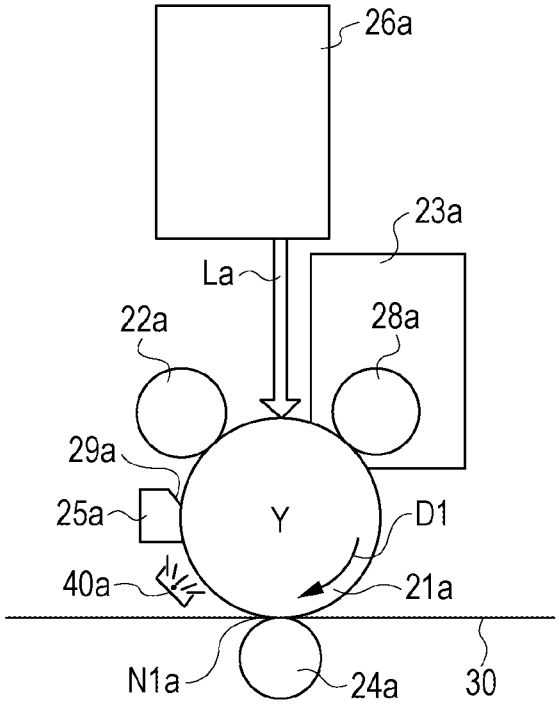
FIG. 5 is a diagram illustrating a configuration related to a modification example of Example 1.

In the present example, the peripheral speed of the photosensitive drum 21 is changeable so as to improve the collection efficiency of the toner of which the amount of electrostatic charge increases due to the toner adhering to the charging brush 35. However, the configuration to improve the collection efficiency is not limited to this. FIG. 5 is a diagram illustrating a configuration related to the present modification example. As illustrated in FIG. 5, for example, a static eliminator 40 capable of corona charging or the like is disposed between the primary transfer portion N1*a* and the cleaning unit 25*a* so as to remove static charges from the toner that has been moved from the intermediate transfer belt 30 to the photosensitive drum 21*a*. This can weaken electrostatic adhesive power acting between the toner and the photosensitive drum 21*a* in the second collection operation, thereby improving the toner collection efficiency of the cleaning blade 29*a*.

Example 2

It is described in. Example 1 that the peripheral speed of the photosensitive drum 21 in the second collection operation is set to be slower than that in the first collection operation. In Example 2, on the other hand, the peripheral speed of the photosensitive drum 21 in the second collection operation is controlled in response to ambient conditions surrounding the image-forming apparatus 10. Note that in the present example, components common to those described in Example 1 are denoted by the same reference symbols, and duplicated description will be omitted.

Table 3 shows the amounts of electrostatic charge of the toner accumulated in the charging brush 35 in respective humidity conditions and occurrence or non-occurrence of image defects due to faulty cleaning. Here, the peripheral speed of the photosensitive drum 21 in the second collection operation was set to be the same as that in the first collection operation. In other words, the peripheral speed of the photosensitive drum 21 in the second collection operation and in the first collection operation was set to 210 mm/sec. Note that the method of measuring the amount of electrostatic charge of toner and the method of evaluating the cleaning performance are the same as those used in Example 1, and the description is not repeated.

It is known that the amount of electrostatic charge of toner and the absolute humidity in the air correlate with each other. The higher the absolute humidity in the air, the lower the amount of electrostatic charge of toner tends to be. As indicated in Table 3, according to the study by the inventors, image defects caused by faulty cleaning did not occur in the ambient environment in which the absolute humidity was 8.9 g/m$^3$ or more.

TABLE 3

| Absolute humidity [g/m$^3$] | Amount of electrostatic charge [μC/g] | Cleaning performance |
|---|---|---|
| 1.1 | −80 | C |
| 3.0 | −70 | C |
| 5.9 | −60 | C |
| 8.9 | −50 | A |
| 12.0 | −40 | A |
| 15.9 | −35 | A |
| 18.1 | −30 | A |
| 21.7 | −30 | A |

The absolute humidity in the present example is obtained in the following manner. As illustrated in FIG. 1, the image-forming apparatus 10 has an environment sensor 6 that serves as a detection unit for detecting ambient temperature and ambient relative humidity. In the present example, the absolute humidity is obtained from a data table that is preinstalled in the controller 3, which serves as the control unit, in accordance with the temperature and the relative humidity detected by the environment sensor 6.

Table 4 is an example of the data table that is preinstalled in the controller 3. In the present example, the controller 3 looks up the data table to obtain the absolute humidity in accordance with the values detected by the environment sensor 6. The controller 3 controls the peripheral speed of the photosensitive drum 21 when the absolute humidity obtained is determined to be less than a predetermined value. More specifically, if the absolute humidity is less than 8.9 g/m$^3$, the peripheral speed of the photosensitive drum 21 in the second collection operation is set to be slower than that in the first collection operation as is the case for Example 1. In other words, in the case of the absolute humidity being 8.9 g/m$^3$ or more, the peripheral speed of the photosensitive drum 21 is not changed in the second collection operation.

TABLE 4

| Absolute humidity [g/m$^3$] according to temperature [° C.] and relative humidity [% RH] | | | | | | | | | | |
|---|---|---|---|---|---|---|---|---|---|---|
| Temperature | Relative humidity [% RH] | | | | | | | | | |
| [° C.] | 10 | 20 | 30 | 40 | 50 | 60 | 70 | 80 | 90 | 100 |
| 40 | 4.9 | 9.8 | 14.6 | 19.5 | 24.4 | 29.3 | 34.2 | 39.0 | 43.9 | 48.8 |
| 35 | 3.7 | 7.3 | 11.0 | 14.6 | 18.3 | 21.9 | 25.6 | 29.2 | 32.9 | 36.5 |
| 30 | 2.7 | 5.4 | 8.2 | 10.9 | 13.6 | 16.3 | 19.0 | 21.7 | 24.5 | 27.2 |
| 25 | 2.0 | 4.0 | 6.0 | 8.0 | 10.0 | 12.0 | 14.0 | 16.1 | 18.1 | 20.1 |
| 20 | 1.5 | 2.9 | 4.4 | 5.9 | 7.3 | 8.8 | 10.3 | 11.7 | 13.2 | 14.7 |
| 15 | 1.1 | 2.1 | 3.2 | 4.3 | 5.3 | 6.4 | 7.4 | 8.5 | 9.6 | 10.6 |
| 10 | 0.8 | 1.5 | 2.3 | 3.1 | 3.8 | 4.6 | 5.3 | 6.1 | 6.9 | 7.6 |
| 5 | 0.5 | 1.1 | 1.6 | 2.2 | 2.7 | 3.2 | 3.8 | 4.3 | 4.9 | 5.4 |

Figure 6:
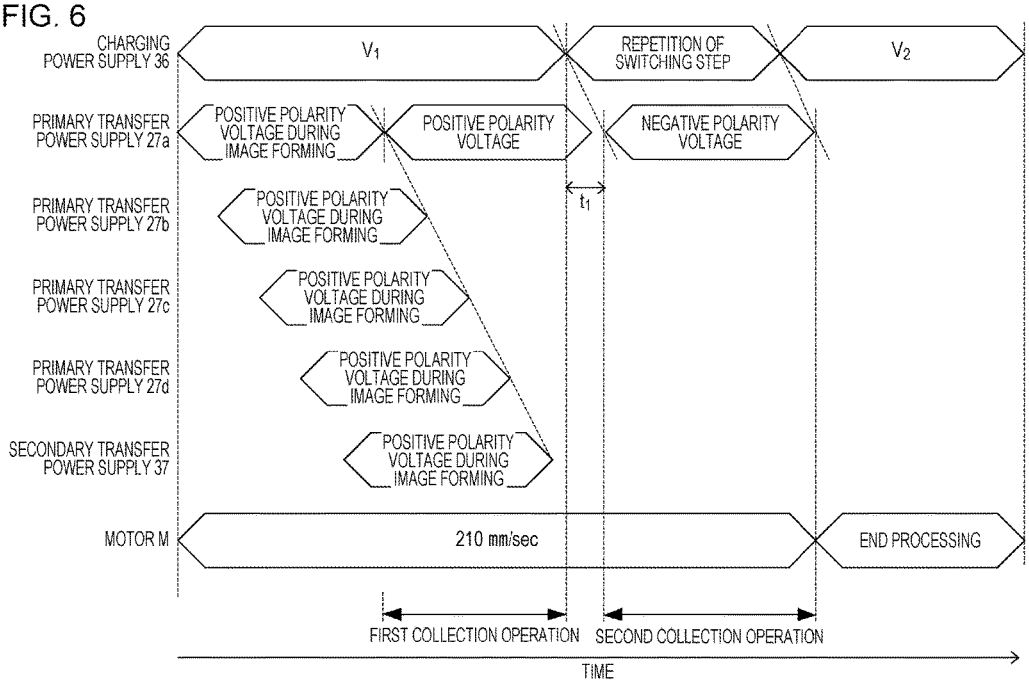
FIG. 6 is a timing diagram illustrating collection operations for residual toner performed in response to ambient conditions around the image-forming apparatus in Example 2.

FIG. 6 is a timing diagram when residual toner is collected in the case of the absolute humidity being 8.9 g/m$^3$ or more in the present example.

As illustrated in FIG. 6, when the secondary transfer of a toner image is completed and the first collection operation for collecting the residual toner that is charged to positive polarity by the charging brush 35 is completed, the repetition of the switching step is started by stopping voltage $V_1$ that the charging power supply 36 applies to the charging brush 35. Here, the timing of stopping voltage $V_1$ is set to t1 milliseconds earlier than the timing at which the primary transfer power supply 27*a* applies a negative polarity voltage to the primary transfer roller 24*a*.

In other words, the negatively charged toner is discharged from the charging brush 35 to the intermediate transfer belt 30 by stopping voltage $V_1$ and is subsequently moved to the primary transfer portion N1*a* of the most upstream image forming section. By the time the negatively charged toner reaches the primary transfer portion N1*a*, the primary transfer power supply 27*a* has already applied a negative polarity voltage to the primary transfer roller 24*a*. As a result, the negatively charged toner, which has been moved from the charging brush 35 to the intermediate transfer belt 30, is further moved from the intermediate transfer belt 30 to photosensitive drum 21*a*. The negatively charged toner is consequently collected by the cleaning unit 25*a* of the photosensitive drum 21*a*. In the present example, when the ambient conditions surrounding the image-forming apparatus 10 are such that the absolute humidity is 8.9 g/m$^3$ or more, the second collection operation is performed in the manner described above.

After the switching step is repeated the predetermined number of times, the voltage that the charging power supply 36 applies to the charging brush 35 is switched to positive polarity voltage $V_2$, and this voltage is maintained. Thus, the discharge of the negatively charged toner from the charging brush 35 to the intermediate transfer belt 30 is completed. In addition, the application of the negative polarity voltage to the primary transfer roller 24*a* is stopped in synchronization with the timing at which a position on the intermediate transfer belt 30 to which the last toner has been discharged passes the primary transfer portion N1*a*.

The voltage applied to the charging brush 35 is subsequently stopped in synchronization with stopping the movement of the intermediate transfer belt 30. Thus, the sequence of the operation is completed while no negatively charged toner having been discharged from the charging brush 35 is left on the intermediate transfer belt 30. Note that in the present example, voltage $V_1$ is set to +1500 V, and voltage $V_2$ is set to +200 V. Elapsed time t1 (milliseconds) is the time required for the intermediate transfer belt 30 to move from the charging brush 35 to the primary transfer portion N1*a* of the most upstream image forming section.

When the ambient conditions surrounding the image-forming apparatus 10 is such that the absolute humidity is 8.9 g/m$^3$ or more, the peripheral speed of the photosensitive drum 21 is not changed in the second collection operation. This can reduce the time required until the image-forming apparatus 10 stops compared with the configuration of Example 1. As a result, the occurrence of image defects caused by the faulty cleaning can be suppressed while reducing the time required for the collection operation for residual toner, except for the case in which the amount of electrostatic charge of toner tends to increase.

In the present example, the absolute humidity is obtained from the data table stored in the controller 3 in accordance with the temperature and the relative humidity detected by the environment sensor 6, and the peripheral speed of the photosensitive drum 21 is controlled according to the absolute humidity obtained. However, the peripheral speed of the photosensitive drum 21 may be controlled according to the relative humidity detected by the environment sensor 6 or may be controlled according to a humidity value that a user enters into the image-forming apparatus 10.

In the present example, the negative polarity voltage is applied to the primary transfer roller 24*a* of the most upstream image forming section. However, the negative polarity voltage may be applied to at least one of the primary transfer rollers 24. Accordingly, it is a matter of choice which one of the primary transfer rollers 24 the negative polarity voltage is applied to or whether or not the negative polarity voltage is applied to a plurality of the primary transfer rollers 24.

Modification Example

In the present example, an absolute humidity of 8.9 g/m$^3$ is set as a threshold value, and the peripheral speed of the photosensitive drum 21 and the intermediate transfer belt 30 is changed when the absolute humidity is lower than the threshold value. However, as indicated in Table 5, the peripheral speed may be changed according to the absolute humidity values. Table 5 shows the absolute humidity values and the preset values of peripheral speed of the photosensitive drum 21 according to the modification example of the present example when performing the second collection operation.

TABLE 5

| Absolute humidity [g/m$^3$] | Peripheral speed of photosensitive drum 21 and intermediate transfer belt 30 [mm/sec] |
|---|---|
| 1.1 | 70 |
| 3.0 | 116 |
| 5.9 | 163 |
| 8.9 | 210 |
| 12.0 | 210 |
| 15.9 | 210 |
| 18.1 | 210 |
| 21.7 | 210 |

Thus, the peripheral speed of the photosensitive drum 1 is changed according to the absolute humidity values in the second collection operation. This can optimize the reduction in the time required for collecting residual toner in accordance with the usage of the apparatus.

In the present example, as described above, the peripheral speed of the photosensitive drum 21 and the intermediate transfer belt 30 is controlled according to the ambient conditions surrounding the image-forming apparatus 10. However, the peripheral speed of the photosensitive drum 21 may be controlled according to the degree of toner consumption. When toner is used less frequently, the amount of electrostatic charge of the toner tends to increase. As a result, when collecting such less-used toner in the second collection operation, the occurrence of image defects caused by the faulty cleaning can be suppressed by controlling the peripheral speed of the photosensitive drum 21 while reducing the time required for the collection operations for residual toner.

While aspects of the present disclosure have been described with reference to exemplary embodiments, it is to be understood that aspects of the present disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-166004 filed Aug. 30, 2017, which is hereby incorporated by reference herein in its entirety.

What is claimed is:

1. An image-forming apparatus, comprising:

an image bearing member that bears a toner image;

an intermediate transfer member that is movable and onto which the toner image is primary-transferred from the image bearing member;

a transfer member that is disposed at a position corresponding to the image bearing member with the intermediate transfer member interposed therebetween;

a power supply that applies a voltage to the transfer member;

a charging unit that is disposed, with respect to a moving direction of the intermediate transfer member, downstream of a secondary transfer portion where the toner image is secondary-transferred from the intermediate transfer member onto a transfer medium and that charges toner that has passed through the secondary transfer portion in a state the charging unit being in contact with the intermediate transfer member;

a charging power supply that applies a voltage to the charging unit;

a contact member configured to contact with the image bearing member and collects toner adhering to the image bearing member; and a control unit configured to perform a first collection operation in which toner that has passed a position at which the charging unit and the intermediate transfer member are in contact with each other in a state in which the charging power supply applies the voltage having a predetermined polarity is moved from the intermediate transfer member to the image bearing member, and a second collection operation in which toner having been moved from the charging unit to the intermediate transfer member is moved from the intermediate transfer member to the image bearing member, wherein the control unit performs the first collection operation by applying the voltage having the predetermined polarity from the power supply to the transfer member and performs the second collection operation by applying a voltage having an opposite polarity opposite to the predetermined polarity from the power supply to the transfer member, and wherein the control unit controls a rotation speed of the image bearing member in such a manner that the rotation speed of the image bearing member in the second collection operation is slower than the rotation speed of the image bearing member in the first collection operation.

2. The image-forming apparatus according to claim 1, wherein the control unit controls the rotation speed of the image bearing member, in response to ambient humidity around the image-forming apparatus, in such a manner that the rotation speed of the image bearing member in the second collection operation is slower than the rotation speed of the image bearing member in the first collection operation.

3. The image-forming apparatus according to claim 2, further comprising a detection unit that detects the ambient humidity around the image-forming apparatus, wherein the control unit controls the rotation speed of the image bearing member in a case that the control unit determines that an absolute humidity obtained from a value detected by the detection unit is lower than a predetermined value.

4. The image-forming apparatus according to claim 1, wherein, before the total number of transfer media onto which toner images are secondary-transferred in the secondary transfer portion exceeds a predetermined number of the transfer media, the control unit controls the rotation speed of the image bearing member in such a manner that the rotation speed of the image bearing member in the second collection operation is slower than the rotation speed of the image bearing member in the first collection operation.

5. The image-forming apparatus according to claim 1, wherein the control unit changes the rotation speed of the image bearing member at a timing after toner is moved from the intermediate transfer member to the image bearing member in the first collection operation and before toner is moved from the charging unit to the intermediate transfer member in the second collection operation.

6. The image-forming apparatus according to claim 1, wherein the predetermined polarity is a polarity opposite to a normal charging polarity of toner, and wherein the toner image born by the image bearing member is primary-transferred from the image bearing member to the intermediate transfer member by applying a voltage having the predetermined polarity from the power supply to the transfer member.

7. The image-forming apparatus according to claim 6, wherein by applying a voltage having the predetermined polarity from the power supply to the transfer member, the toner image born by the image bearing member is primary-transferred from the image bearing member to the intermediate transfer member and the first collection operation is performed.

8. The image-forming apparatus according to claim 7, wherein a plurality of the image bearing members and a plurality of the transfer members are disposed, and wherein in a case that the control unit performs the first collection operation, toner that has passed a position at which the charging unit and the intermediate transfer member are in contact with each other in a state in which the charging power supply applies the voltage having the predetermined polarity is moved from the intermediate transfer member to the image bearing member that is disposed upstream of any other image bearing members with respect to a moving direction of the intermediate transfer member.

9. The image-forming apparatus according to claim 1, wherein the predetermined polarity is a polarity opposite to a normal charging polarity of toner, and wherein the control unit performs the second collection operation when a toner image is not primary-transferred from the image bearing member to the intermediate transfer member.

10. The image-forming apparatus according to claim 9, wherein a plurality of the image bearing members and a plurality of the transfer members are disposed, and wherein in a case that the control unit performs the second collection operation, toner that has been moved from the charging unit to the intermediate transfer member is moved from the intermediate transfer member to the image bearing member that is disposed upstream of any other image bearing members with respect to a moving direction of the intermediate transfer member.

11. The image-forming apparatus according to claim 1, wherein in the second collection operation, the control unit alternately applies voltages from the charging power supply to the charging unit and thereby moves toner from the charging unit to the intermediate transfer member, the voltages having the predetermined polarity and being lower in absolute value than a voltage that the charging power supply applies to the charging unit in the first collection operation, the voltages being different from each other.

12. The image-forming apparatus according to claim 1, wherein the control unit moves toner from the charging unit to the intermediate transfer member in the second collection operation by alternately forming a state in which the charging power supply does not apply a voltage to the charging unit and a state in which the charging power supply applies to the charging unit a voltage that is lower in absolute value than a voltage that the charging power supply applies to the charging unit in the first collection operation.

13. The image-forming apparatus according to claim 1, wherein the charging power supply moves toner from the charging unit to the intermediate transfer member in the second collection operation by alternately applying, to the charging unit, a voltage having the opposite polarity and a voltage that is lower in absolute value than a voltage that the charging power supply applies to the charging unit in the first collection operation.

14. The image-forming apparatus according to claim 1, wherein the charging unit is a brush member having electroconductivity.

15. The image-forming apparatus according to claim 14, wherein toner that is moved to the image bearing member in the second collection operation after being moved from the charging unit to the intermediate transfer member is toner that has adhered, after passing through the secondary transfer portion, to the brush member to which a voltage having the predetermined polarity has been applied and that has been rubbed between the brush member and the intermediate transfer member.

16. The image-forming apparatus according to claim 1, wherein the contact member is disposed, with respect to a rotation direction of the image bearing member, downstream of a primary transfer portion where the image bearing member and the intermediate transfer member are in contact with each other, and when performing the first collection operation and the second collection operation, toner that has been moved from the intermediate transfer member to the image bearing member is collected by the contact member.

17. An image-forming apparatus, comprising:

an image bearing member that bears a toner image;

an intermediate transfer member that is movable and onto which the toner image is primary-transferred from the image bearing member;

a transfer member that is disposed at a position corresponding to the image bearing member with the intermediate transfer member interposed therebetween;

a power supply that applies a voltage to the transfer member;

a charging unit that is disposed, with respect to a moving direction of the intermediate transfer member, downstream of a secondary transfer portion where the toner image is secondary-transferred from the intermediate transfer member onto a transfer medium, the charging unit charging toner that has passed through the secondary transfer portion while the charging unit being in contact with the intermediate transfer member;

a charging power supply that applies a voltage to the charging unit;

a contact member that collects toner adhering to the image bearing member while the contact member being in contact with the image bearing member;

a control unit configured to perform a first collection operation in which toner that has passed a position at which the charging unit to which the charging power supply applies a voltage having a predetermined polarity and the intermediate transfer member are in contact with each other is moved from the intermediate transfer member to the image bearing member by applying the voltage having the predetermined polarity from the power supply to the transfer member, and a second collection operation in which toner having been moved from the charging unit to the intermediate transfer member is moved from the intermediate transfer member to the image bearing member by applying a voltage having an opposite polarity opposite to the predetermined polarity from the power supply to the transfer member; and a static eliminator unit that is disposed downstream of a position at which the image bearing member is in contact with the intermediate transfer member and upstream of a position at which the contact member is in contact with the image bearing member with respect to a rotation direction of the image bearing member, the static eliminator unit removing static charges from toner that has been moved from the intermediate transfer member to the image bearing member when performing the second collection operation.

* * * * *